US006933918B1

(12) United States Patent
Park et al.

(10) Patent No.: US 6,933,918 B1
(45) Date of Patent: Aug. 23, 2005

(54) METHOD AND APPARATUS FOR DRIVING LIQUID CRYSTAL DISPLAY

(75) Inventors: Man Hyo Park, Kyounggi-do (KR); Hong Bae Park, Kyounggi-do (KR)

(73) Assignee: LG.Philips LCD Co., Ltd., Seoul (KR)

( * ) Notice: Subject to any disclaimer, the term of this patent is extended or adjusted under 35 U.S.C. 154(b) by 43 days.

(21) Appl. No.: 10/730,100

(22) Filed: Dec. 9, 2003

(30) Foreign Application Priority Data

Dec. 10, 2002 (KR) ..... 10-2002-0078378

(51) Int. Cl.[7] ..... G09G 3/36
(52) U.S. Cl. ..... 345/102; 345/87
(58) Field of Search ..... 345/102, 87, 88, 345/99; 349/61, 62; 362/227, 230

(56) References Cited

U.S. PATENT DOCUMENTS

| | | | | |
|---|---|---|---|---|
| 4,907,862 | A * | 3/1990 | Suntola | 349/61 |
| 5,175,637 | A * | 12/1992 | Jones et al. | 349/1 |
| 5,337,068 | A * | 8/1994 | Stewart et al. | 345/88 |
| 5,592,193 | A * | 1/1997 | Chen | 345/102 |
| 2003/0117364 | A1 * | 6/2003 | Miyake | 345/102 |

* cited by examiner

*Primary Examiner*—Kent Chang
(74) *Attorney, Agent, or Firm*—Morgan Lewis & Bockius LLP

(57) ABSTRACT

A driving apparatus is provided for a for a liquid crystal display. The driving apparatus includes a lamp housing, a plurality of lamps arranged in the lamp housing, and a lamp driver. The lamp driver drives a first set of the plurality of lamps to sequentially turn on and off and substantially simultaneously drives a second set of the lamps to be constantly turned on.

20 Claims, 12 Drawing Sheets

METHOD AND APPARATUS FOR DRIVING LIQUID CRYSTAL DISPLAY

The present invention claims the benefit of Korean Patent Application No. P2002-78378 filed in Korea on Dec. 10, 2002, which is hereby incorporated by reference.

BACKGROUND OF THE INVENTION

1. Field of the Invention

The present invention relates to a driving apparatus and method of driving a liquid crystal display, and more particularly, to a driving apparatus and method of driving a liquid crystal display that improves the brightness of the liquid crystal display in accordance with a back light sequential driving system.

2. Description of the Related Art

The liquid crystal display (LCD), is light weight, thin, and low in power consumption. As a result, LDCs have been increasingly applied in a wide variety of applications including office automation instruments, and audio/video devices. The LCD displays a desired picture on a screen by controlling the transmissivity of light beam in accordance with a video signal applied to a plurality of control switches arranged in a matrix.

The LCD with such a configuration has been replacing the cathode ray tube (CRT) due to the above mentioned light weight and low power consumption. One of the reasons facilitating the increased use of LCDs is technological innovation such as the picture quality improvement of the LCD. Though the cathode ray tube CRT uses an impulse of light emission by the scan of an electron gun, the LCD uses a hold-type of the light emission employing a back light system where a linear lamp (fluorescent lamp) is an illuminating light source. As a result, it is impossible to display a perfect moving picture. In other words, when a moving picture is displayed by the LCD, moving picture contour deterioration occurs due to the hold characteristic, thereby causing deterioration of picture quality.

FIG. 1 is a simulation diagram illustrating a mechanism of how a moving picture contour deterioration is generated when the moving picture is displayed on the display device such as LCD having a hold property. FIG. 1(A) illustrates that a white image being moved in an direction of arrow A is displayed on part of a black background of the LCD. FIG. 1(B) is an enlarged diagram of the boundary area of the black/white images. FIG. 1(C) is a diagram explaining the cause of occurrence of the moving picture contour deterioration. FIG. 1(D) is an enlarged diagram representing the moving picture contour deterioration. Wherein each of squares shown in FIG. 1 represents a pixel. Further, the moving picture contour deterioration is indicated as "a blurring" or as "a moving picture blurring" in FIG. 1.

As illustrated in FIG. 1(C), where one row of the black/white boundary area of FIG. 1(B) is displayed in a time series, a line of sight moves along arrow B, which is slantingly drawn from top left to bottom right, as a displayed picture is moved in an arrow A direction. The brightness of a pixel is sustained or held while a display of one frame is moving. Because the brightness is represented by the integration of the brightness of pixel, the moving picture contour deterioration occurs as illustrated in FIG. 1(D).

On the other hand, such moving picture contour deterioration does not occur in the impulse type of cathode ray tube "CRT". More specifically, FIG. 2 is the same simulation diagram as FIG. 1(C) where the moving picture is displayed in the CRT not having a hold property. Because the pixel is not displayed while the picture moves between frames, even though the line of sight moves along the arrow B in accordance with the movement of a display picture in an arrow A direction, there occurs no moving picture contour deterioration. In other words, in the impulse type of CRT, black data is displayed between an initial frame and a new frame, so the display picture gets visually vivid due to the black data.

Accordingly, as illustrated in FIGS. 1(C) and 2, an observer's perceived image in the moving picture is vividly displayed in the CRT. As compared with this, the displayed picture becomes blurred in the LCD because of the hold property of liquid crystal in moving pictures. The difference of such a perceived image results from the integration effect of image that temporarily lasts in the eye pursuing the movement. Accordingly, even though the response speed of the LCD is fast, the observer sees a blurred screen owing to a discord between eye's movement and a static image of each frame.

Accordingly, there is a back light sequential driving system for an LDC employing a direct back light where a plurality of lamps are arranged horizontally to prevent the moving picture contour deterioration. The LCD according to the back light sequential driving system turns on/off a plurality of lamps in synchronization with the start time of the scan signal of the display picture, and in addition, when the brightness signals of the same level are applied, the display brightness of the LCD makes the time integration value of the brightness value equalized between each frames, thereby preventing the moving picture contour deterioration from occurring when displaying the moving picture similar to that of an impulse type light emission such as the CRT.

Referring to FIGS. 3 and 4, the driving apparatus for the liquid crystal display employing a back light sequential driving system includes an LCD panel 2 having TFTs at intersection areas where data lines and gate lines cross, a data driver 4 for supplying data to the data lines of the LCD panel 2, a gate driver 6 for supplying gate pulses to the gate lines of the LCD panel 2, a back light unit 10 for providing a light beam to the LCD panel 2 by sequentially driving a plurality of lamps 30, a lamp driver 12 for controlling the back light unit 10, and a timing controller 8 for controlling the data driver 4 and the gate driver 6 as well as driving the lamp driver 12.

A back light unit 10, as shown in FIG. 4, includes a plurality of lamps 30, a lamp housing 22 enclosing the plurality of lamps 30, and a diffusion plate 20 which covers the front of the lamp housing 22. The plurality of lamps 30 is sequentially driven in response to the control of the lamp driver 12. The lamp housing 22 encloses the plurality of lamps 30 and directs the light beam from the plurality of lamps 30 toward the diffusion plate 20 using a reflection surface 24. The diffusion plate 20 allows the light radiated from a plurality of lamps 30 to proceed to the liquid crystal display panel 2 with a wide angle of incidence. The diffusion plate 20 uses a member coated on both sides with films of transparent resin to achieve optical diffusion.

In the LCD panel 2, a liquid crystal is injected between two glass substrates. The TFTs are formed at the intersection areas of the data lines and the gate lines of the liquid crystal display panel 2, thereby providing the liquid crystal cell with the data on the data line in response to a scanning pulse from the gate driver 6. The source electrode of the TFT is connected to the data line, the drain electrode is connected to a pixel electrode of the liquid crystal cell, and the gate electrode of the TFT is connected to the gate line. The liquid crystal display panel 2 is stacked on the diffusion plate 20 of the back light unit 10.

The timing controller 8 rearranges the digital video data supplied from a digital video card (not shown) by red (R), green (G), and blue (B), respectively. The data (R, G, B) rearranged by the timing controller 8 is supplied to the data driver 4. Further, the timing controller 8 generates a data control signal and a gate control signal using the horizontal/vertical synchronization signal (H/V) input to itself. The data control signal including a dot clock (Dclk), a source shift clock (SSC), a source enable signal (SOE), and a polarity inversion signal (POL) is supplied to the data driver 4. The gate control signal including a gate start pulse (GSP), a gate shift clock (GSC), and a gate output enable (GOE) is supplied to the gate driver 6. Further, the timing controller 8 controls the lamp driver 12 so that the back light unit 10 may sequentially be driven at a point of time when the data is completely supplied to the liquid crystal cell.

The data driver 4 latches the sampled data line by line after sampling the data in accordance with data control signal from the timing controller 8, and then converts the latched data into an analog gamma voltage from a gamma voltage supplying part (not shown). The gate driver 6 includes a shift register for generating the gate pulse sequentially in response to the gate start pulse (GSP) among the gate control signal from the timing controller 8, and a level shifter for shifting the voltage of the gate pulse to the voltage level suitable for driving the liquid crystal cell. The lamp driver 12 drives a plurality of lamps 30 of the back light unit 10 sequentially in response to the lamp driving control signal from the timing controller 8. More specifically, the lamp driver 12 drives a plurality of lamps 30 sequentially after the data voltage is supplied to the liquid crystal cell completely.

In the driving apparatus of the liquid crystal display device as described, a plurality of lamps 30 are driven sequentially when a plurality of gate lines are driven during one frame as shown in FIG. 5. More specifically, when the gate pulse is supplied to the gate lines of at least GL_1 to GL_1+M among N gate lines and the data voltage is completely supplied through the data lines to the liquid crystal cell, the first lamp 30 is turned off after being turned on. Further, when the gate pulse is supplied to the gate lines of at least GL_(1+M)+1 to GL_1+2M among the N gate lines and the data voltage is supplied through the data lines to the liquid crystal cell, the second lamp is turned off after being turned-on.

Here, the computation of the brightness is explained according to the above described scanning back light driving method. In the first place, the brightness of hold-type back light driving method constantly turning on back light is defined as equation 1. Here, it is assumed that the brightness of 1 frame is 1 in case that one lamp is turned on.

$$\text{Brightness(Hold-Type)} = (1+1+1+\cdots+1)/1\ \text{Frame Time} = n/1\ \text{Frame} \quad \text{[Equation 1]}$$

Hereby, the brightness of the scanning back light driving method is reduced in inverse proportion to the number of the lamps by contrast with the hold-type back light driving method as illustrated in equation 2.

$$\text{Brightness(Scanning Type)} = (1/n+1/n+1/n+\cdots+1/n)/1\ \text{Frame} = 1/1\ \text{Frame} \quad \text{[Equation 2]}$$

SUMMARY OF THE INVENTION

Accordingly, the present invention is directed to a driving apparatus and method of liquid crystal display that substantially obviates one or more of the problems due to limitations and disadvantages of the related art.

An object of the present invention is to provide a driving apparatus and method of liquid crystal display for improving the brightness of liquid crystal display according to a back light sequential driving system.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the driving apparatus and method of liquid crystal display includes a driving apparatus for a liquid crystal display comprises a lamp housing; a plurality of lamps arranged in the lamp housing; and a lamp driver to drive a first set of the plurality of lamps to sequentially turn on and off and to substantially simultaneously drive a second set of the lamps to be constantly turned on.

In another aspect, a driving method for a liquid crystal display having a plurality of lamps disposed in a lamp housing comprises the steps of sequentially turning on and off a first set of the plurality of lamps during one frame; and turning on a second set of the plurality of lamps simultaneously with the step of sequentially turning on and off the first set of lamps, the second set of lamps being turned on constantly during the one frame.

In another aspect, a liquid crystal display comprises a liquid crystal display panel; a lamp housing having a plurality of lamps arranged therein to provide light to the liquid crystal panel; and a lamp driver to drive a first set of the plurality of lamps to sequentially turn on and off and to substantially simultaneously drive a second set of the lamps to be constantly turned on.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
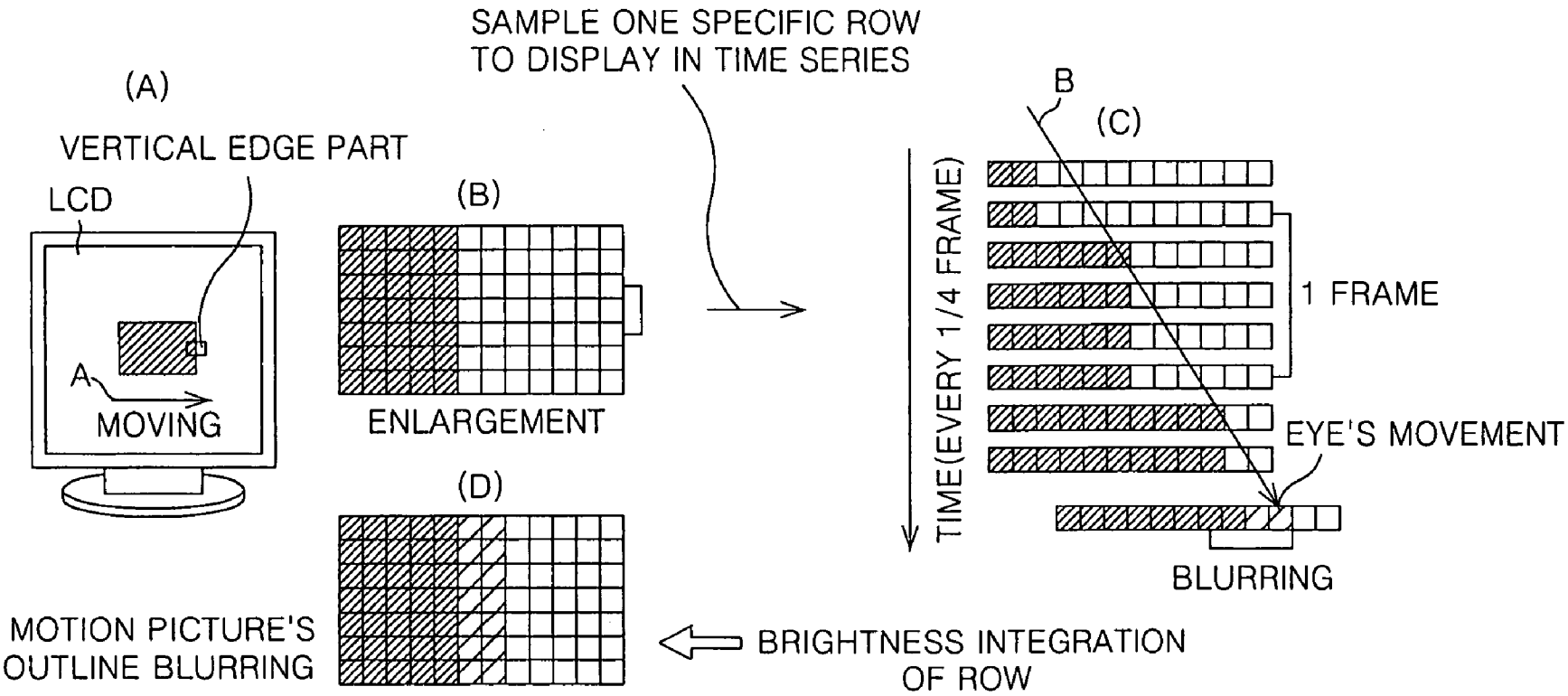
FIG. 1 RELATED ART
FIG. 1 is a simulation diagram illustrating the mechanism about the moving picture image contour degradation generation in case of displaying moving picture image with a displaying device having hold-characteristic of a related art liquid crystal display.
Figure 2:
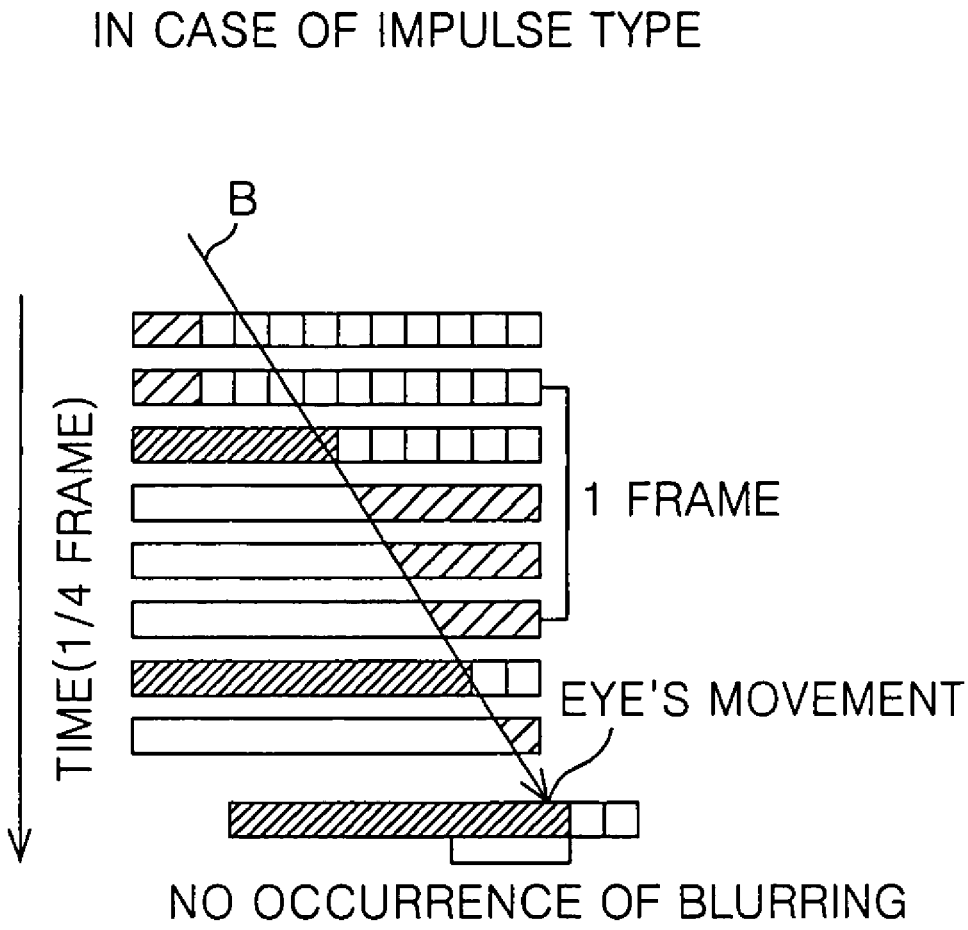
FIG. 2 RELATED ART
FIG. 2 is a simulation diagram identical to FIG. 1(C) in case of displaying the moving picture in a cathode ray tube not having hold-characteristic.
Figure 3:
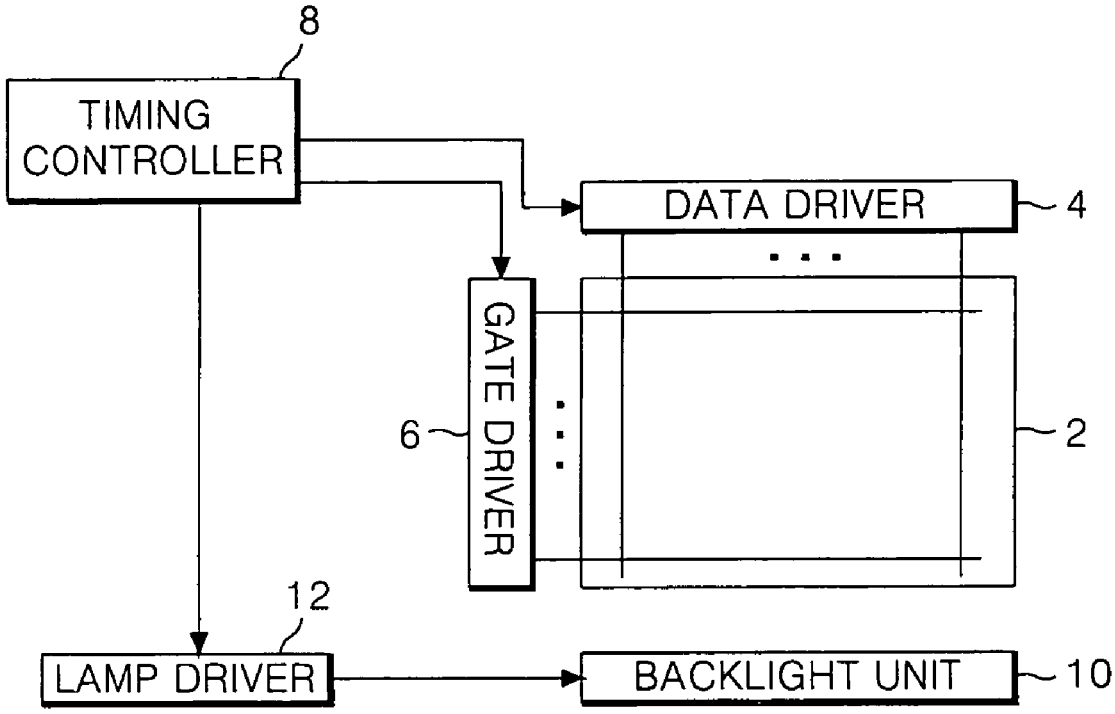
FIG. 3 RELATED ART
FIG. 3 is a block diagram illustrating a driving apparatus of a related art liquid crystal display.
Figure 4:
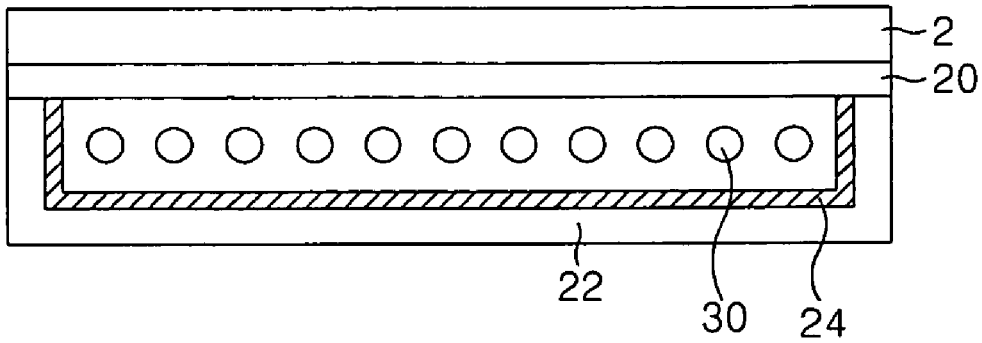
FIG. 4 RELATED ART
FIG. 4 is a sectional view illustrating a back light unit and a liquid crystal display panel as shown in FIG. 3.
Figure 5:
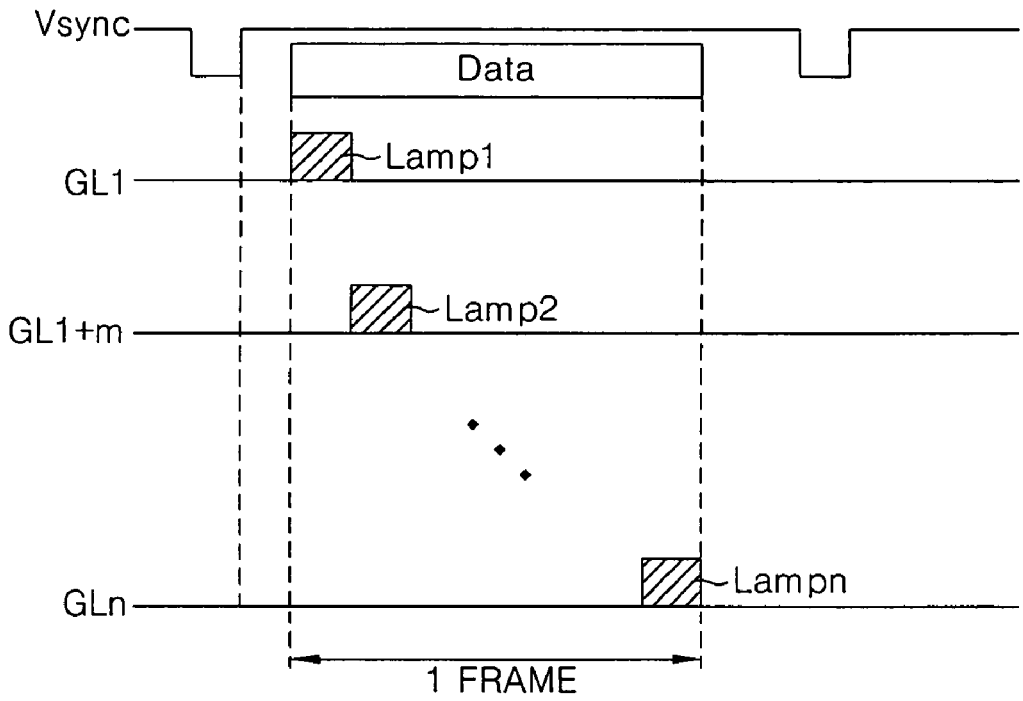
FIG. 5 RELATED ART
FIG. 5 is a timing diagram illustrating a driving method of the related art liquid crystal display as shown in FIG. 3.
Figure 6:
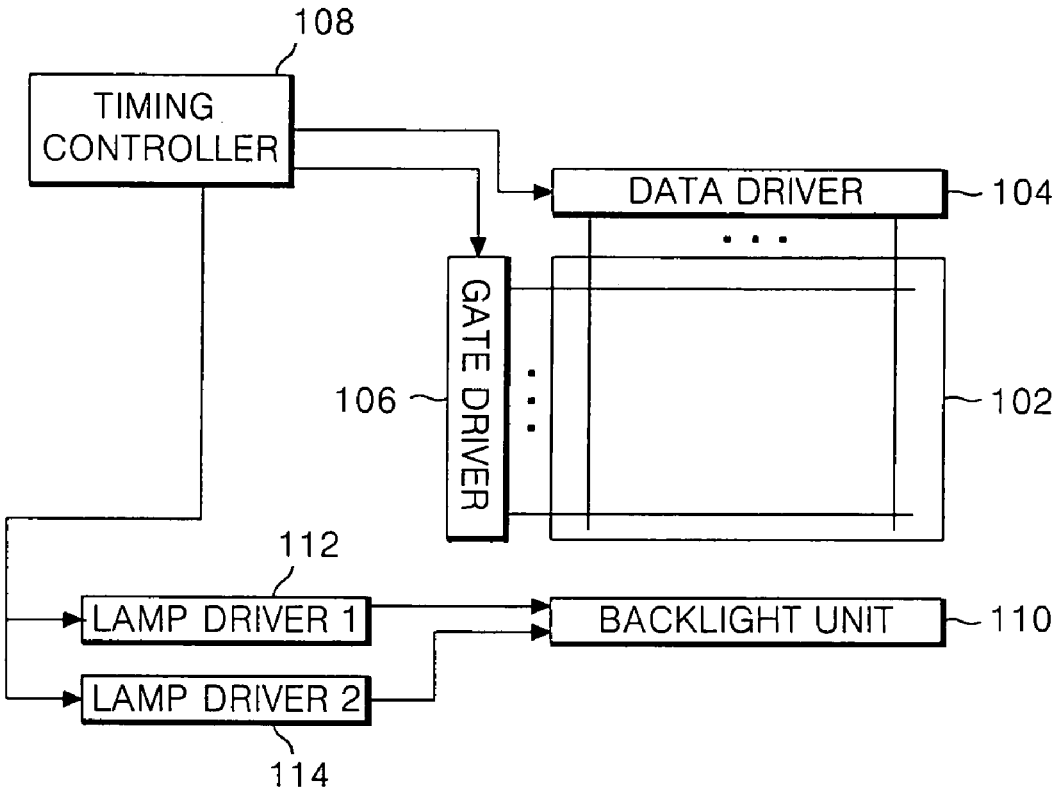
FIG. 6 is a block diagram illustrating a driving apparatus of a liquid crystal display according to an embodiment of the present invention.
Figure 7:
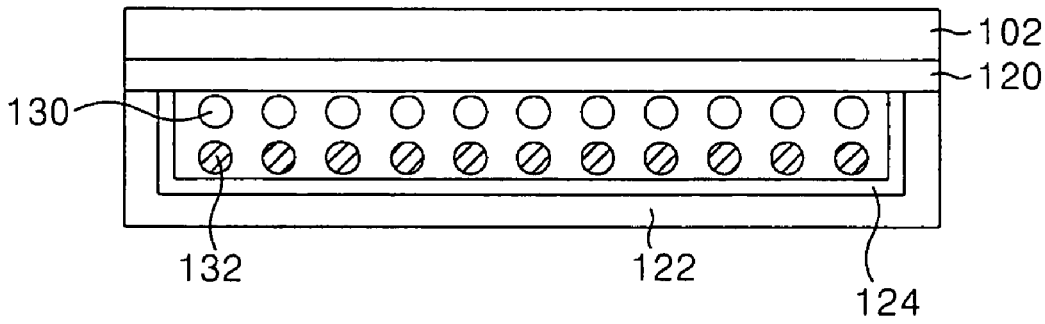
FIG. 7 is a sectional view illustrating a back light unit and a liquid crystal display panel as shown in FIG. 6.

Referring to FIGS. 6 and 7, a driving apparatus of a liquid crystal display employs a back light sequential driving scheme according to an embodiment of the present invention. The driving apparatus includes a liquid crystal display panel 102 in which data lines and gate lines intersect with TFTs at the intersections, a data driver 104 for supplying data to the data lines of the liquid crystal display panel 102, a gate driver 106 for supplying gate pulses to the gate lines of the liquid crystal display panel 102, a back light unit 110 for providing light to the liquid crystal display panel 102 using a plurality of first and second lamps 130, 132, first and second lamp drivers 112, 114 for controlling the first and the second lamps 130, 132 in the back light unit 110, and a timing controller 108 for driving the first and the second lamp drivers 112, 114 as well as for controlling the data driver 104 and the gate driver 106.

The back light unit 110 in a driving apparatus of a liquid crystal display according to a configuration as shown in FIG. 7 includes the first and the second lamps 130, 132 arranged in the first and the second rows, a lamp housing 122 enclosing the lamps 130, 132, and a diffusion plate 120 covering the front of the lamp housing 122.

The lamps 130, 132 are driven in response to the control of each of the first and the second lamp drivers 112, 114 arranged in the first and the second row as a cold cathode fluorescent tube (CCFL) or a light emitting diode. More specifically, the first lamps 130 arranged in the first row are driven sequentially by the first lamp driver 112, and the second lamps 132 arranged in the second row are constantly turned on by the second lamp driver 114.

The lamp housing 122 encloses the first and the second lamps 130, 132 and makes the light beam progress from the first and the second lamps 130, 132 to the diffusion plate 120 through a reflection surface 124. The diffusion plate 120 enables the light from the first and the second lamps 130, 132 to pass to the liquid crystal display panel 102 with a wide angle of incidence. The diffusion plate 120 may use a member coated on both sides with films of transparent resin.

In the liquid crystal display panel 102, liquid crystal is injected between two glass substrates. The TFTs are formed at the intersection areas of the data lines and the gate lines of the liquid crystal display panel 102 for supplying data from the data lines to a liquid crystal cell in response to a scanning pulse from the gate driver 106. The source electrode of each TFT is connected to a respective gate line, the drain electrode of each TFT is connected to a respective pixel electrode of the liquid crystal cell, and the gate electrode of each TFT is connected to a respective gate line. The liquid crystal display panel 102 is stacked on the diffusion plate 120 of the back light unit 110.

The timing controller 108 rearranges the digital video data supplied from a digital video card (not shown) by red (R), green (G), and blue (B), respectively. The data (R,G,B) rearranged by the timing controller 108 is supplied to the data driver 104. Further, the timing controller 108 generates data control signals and gate control signals in use of the horizontal/vertical synchronization signals (H, V) provided to itself. The data control signal is supplied to the data driver 104 including a dot clock (Dclk), a source shift clock (SSC), a source enable signal (SOE), and a polarity inversion signal (POL). The gate control signal is supplied to the gate driver 106 including a gate start pulse (GSP), a gate shift clock (GSC), and a gate output enable (GOE). Further, at the moment that data is completely supplied to the liquid crystal cell, the timing controller 108 drives the back light unit 110 sequentially and, at the same time, controls the first and the second lamp drivers 112, 114 to be driven.

After the data driver 104 samples the data according to the data control signal from the timing controller 108, it latches the sampled data line by line and converts the latched data to the analog gamma voltage from gamma voltage supplying part (not shown). The gate driver 106 includes a shift register generating gate pulses sequentially and a level shifter shifting a gate pulse voltage to the voltage level suitable for driving the liquid crystal in response to the gate start pulse (GSP) among the gate control signals from the timing controller 108.

The first lamp driver 112 sequentially drives the first lamps 130 arranged in the first row of the back light unit 110 in response to the lamp driving control signal from the timing controller 108. More specifically; after the data voltage is completely supplied to the liquid crystal cell, the first lamp driver 112 turns on/off the first lamps 130 sequentially. In response to the lamp driving control signal from the timing controller 108, the second lamp driver 114 drives the second lamps 132 arranged in the second row of the back light unit 110, and turns the second lamps 132 constantly on. At this time, the current supplied to the first lamp 130 arranged in the first row is larger than the current supplied to the second lamps 132 arranged in the second row.

Figure 8:
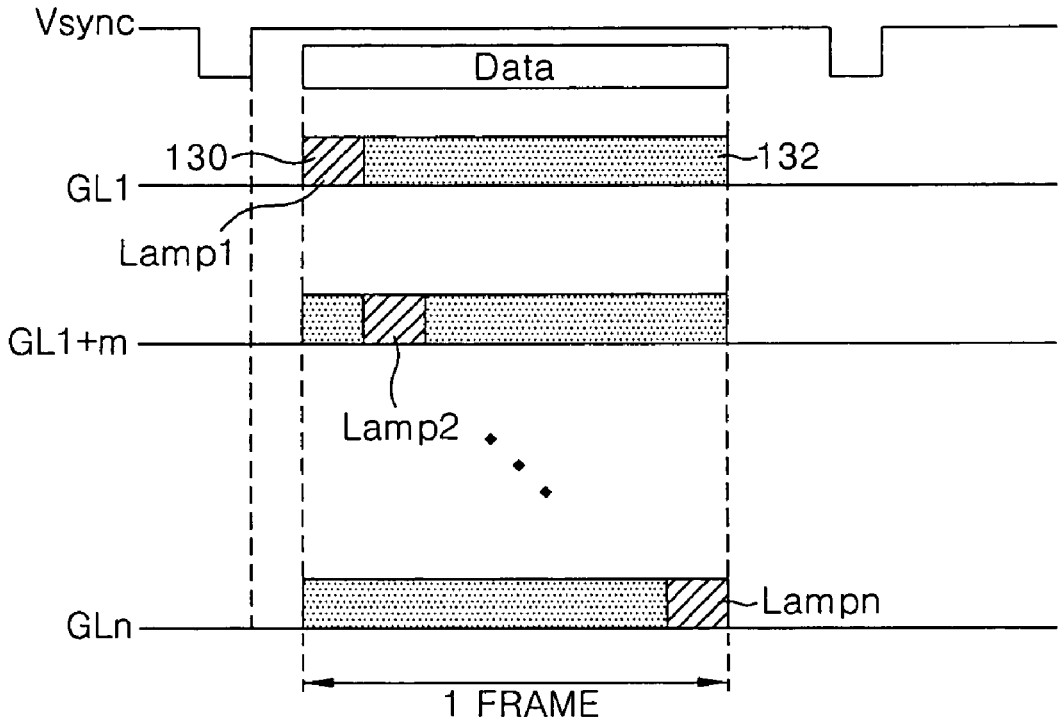
FIG. 8 is a timing diagram illustrating a driving method of the liquid crystal display according to the embodiment of the present invention as shown in FIG. 6.

In the driving apparatus of the liquid crystal display according to the embodiment of the present invention as shown in FIG. 8, the first lamps 130 are turned on/off sequentially when a plurality of gate lines are driven within one frame. In other words, when the gate pulse is supplied to at least gate lines GL_1 to GL_1+M among N gate lines and when data voltage is supplied to the data lines, the first lamp among a plurality of first lamps 130 arranged in the first row is turned off after being turned-on. At this time, the lamps 132 arranged in the second row are turned on and maintain the state of being turned-on. Further, when the gate pulse is supplied to at least gate lines GL_(1+M)+1 to GL_1+2M among the N gate lines and when data voltage is supplied to the data lines, the second lamp among the first lamps 130 arranged in the first row is turned off after being turned-on. Hereby, in respect to the liquid crystal display panel 102 the light beam from the first lamps 130 arranged in the first row driven sequentially, and the light beam from the second lamps 132 arranged in the second row constantly driven in a state of being turned-on are irradiated to the liquid crystal display panel 102.

Accordingly, the driving apparatus of the liquid crystal display of the first embodiment of the present invention does not use all the lamps 130, 132 all for being turned-on/off. In particular, the first lamps 130—corresponding to the some of the lamps such as half of the lamps—use a scanning back light driving method, the second lamps 132 constantly maintain the state of being turned-on, thereby improving the brightness. More specifically, as described above, the first lamps 130 arranged in the first row among the first and the second lamps 130, 132 arranged in the first and the second rows in the lamp housing 120 are driven by the scanning back light driving method keeping on/off, and the plurality of the second lamps 132 arranged in the second row constantly maintain the state of being turned-on, so the brightness is improved as in the following equation 3.

$$\text{Brightness}=(n+1)/1\text{Frame} \qquad \text{[Equation 3]}$$

As described in equation 3, because n (the total number of lamps) is larger than 1, the brightness achieved by the driving apparatus of the liquid crystal display is higher than that of the related art scanning back light driving method.

Alternatively, in the driving apparatus of the liquid crystal display according to the configuration as shown in FIG. 7, the first lamps 130 arranged in the first row of the lamp housing 122 are driven so that they may constantly maintain a constant the state of turned-on state, and the plurality of the second lamps 132 arranged in the second row can be driven by the scanning back light driving method to be turned on/off. As a result, the brightness achieved by the driving apparatus of the liquid crystal display is higher than that of the related art scanning back light driving method.

Figure 9:
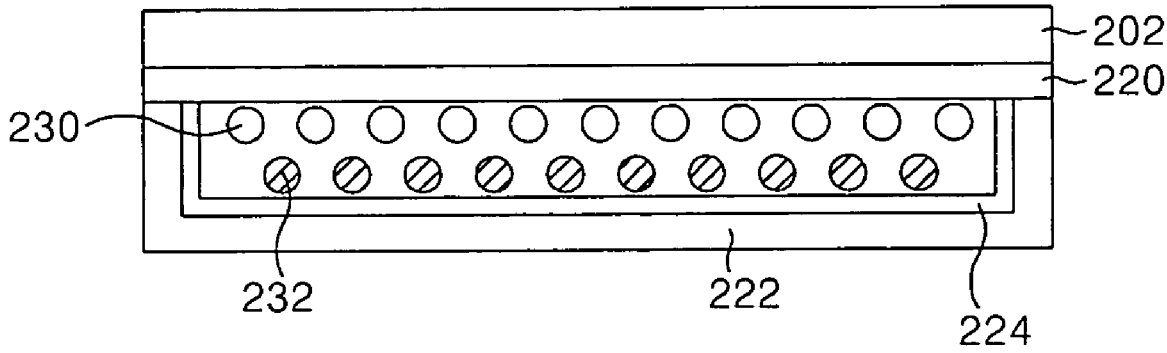
FIG. 9 is a sectional view illustrating a back light unit and a liquid crystal display panel in a driving apparatus of a liquid crystal display according to the another embodiment of the present invention.

Because a driving apparatus of a liquid crystal display of FIG. 9 is similar to the driving apparatus of the liquid crystal display according to the configuration as shown in FIG. 7 except for the arrangement structure of the first and the second lamps 230, 232 arranged in a lamp housing 222, the explanation about each component will be omitted.

In the driving apparatus of FIG. 9, the first and the second lamps 230, 232 are arranged zigzag in the lamp housing 222. More specifically, the second lamps 232 arranged in the second row are each disposed between corresponding ones of the first lamps 230, arranged in the first row. A diffusion plate 220 is stacked on the lamp housing 222, and a liquid crystal panel 202 is stacked on the diffusion plate 220. Among these, the first lamps 230 arranged in the first row are driven by the scanning back light driving method turned on/off sequentially, and the second lamps 232 arranged in the second row is driven so that they constantly maintain a turned-on state. At this time, the current supplied to the first lamps 230 arranged in the first row is larger than that supplied to the second lamps 232 arranged in the second row. Further, the brightness is higher than that of the related scanning back light driving method.

Alternatively, in the driving apparatus of the liquid crystal display according to the configuration as illustrated in FIG. 9, the first lamps 230 arranged in the second row in the lamp housing 222 can be driven so that they may constantly maintain a turned-on state, and the plurality of the second lamps 232 arranged in the second row can be driven by the scanning back light driving method to be turned on/off. As described above, the brightness achieved by the driving apparatus of the liquid crystal display is higher than that of the related art scanning back light driving method.

Figure 10:
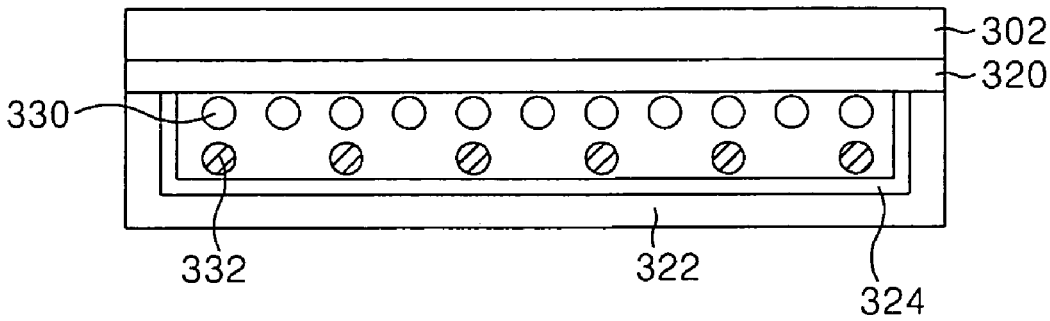
FIG. 10 is a sectional view illustrating a back light unit and a liquid crystal display panel in a driving apparatus of a liquid crystal display according to another embodiment of the present invention.

Because a driving apparatus of a liquid crystal display of FIG. 10 is similar to the driving apparatus of the liquid crystal display according to the configuration as shown in FIG. 7, except for the arrangement structure of the first and the second lamps 330, 332 arranged in a lamp housing 322, the explanation about each component will be omitted.

In the driving apparatus of FIG. 10, the first lamps 330 are arranged in the first row of the lamp housing 322 and the second lamps 332 arranged in the second row are overlapped with the first lamps 330 of the odd-numbered lamps of the first lamps 330 arranged in the first row. A diffusion plate 320 is stacked on the lamp housing 322, and a liquid crystal panel 302 is stacked above the diffusion plate 320. The first lamps 330 arranged in the first row are sequentially driven by the scanning back light driving method turned to be on/off, and the second lamps 332 arranged in the second row are driven to constantly maintain a turned-on state. At this time, the current supplied to the first lamps 330 arranged in the first row is larger than that supplied to the second lamps 332 arranged in the second row. Further, the brightness is higher than that of the related art scanning back light driving method.

Alternatively, in the driving apparatus of the liquid crystal display according to the configuration as shown in FIG. 10, the first lamps 330 arranged in the second row of the lamp housing 322 are driven so that they may constantly maintain a turned-on state, and the plurality of the second lamps 332 arranged in the second row can be driven by the scanning back light driving method to be turned on/off. As described above, the brightness of the driving apparatus of the liquid crystal display is higher than that of the related art scanning back light driving method.

On the other hand, a driving apparatus of a liquid crystal display according to another embodiment, in which a plurality of lamps is arranged in more than two rows in the lamp housing, can drive the lamps as dividing the driving method of the lamps of each row into the scanning back light driving method and the hold-type back light driving method.

Figure 11:
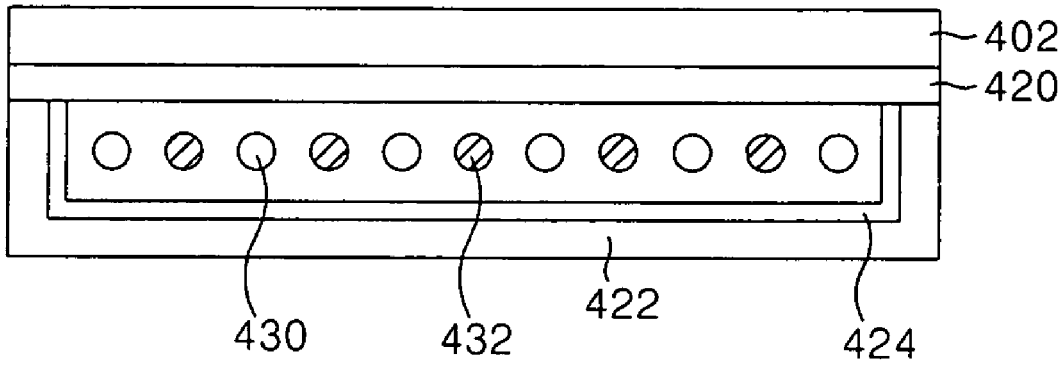
FIG. 11 is a sectional view illustrating a back light unit and a liquid crystal display panel in a driving apparatus of a liquid crystal display according to another embodiment of the present invention.
Figure 12:
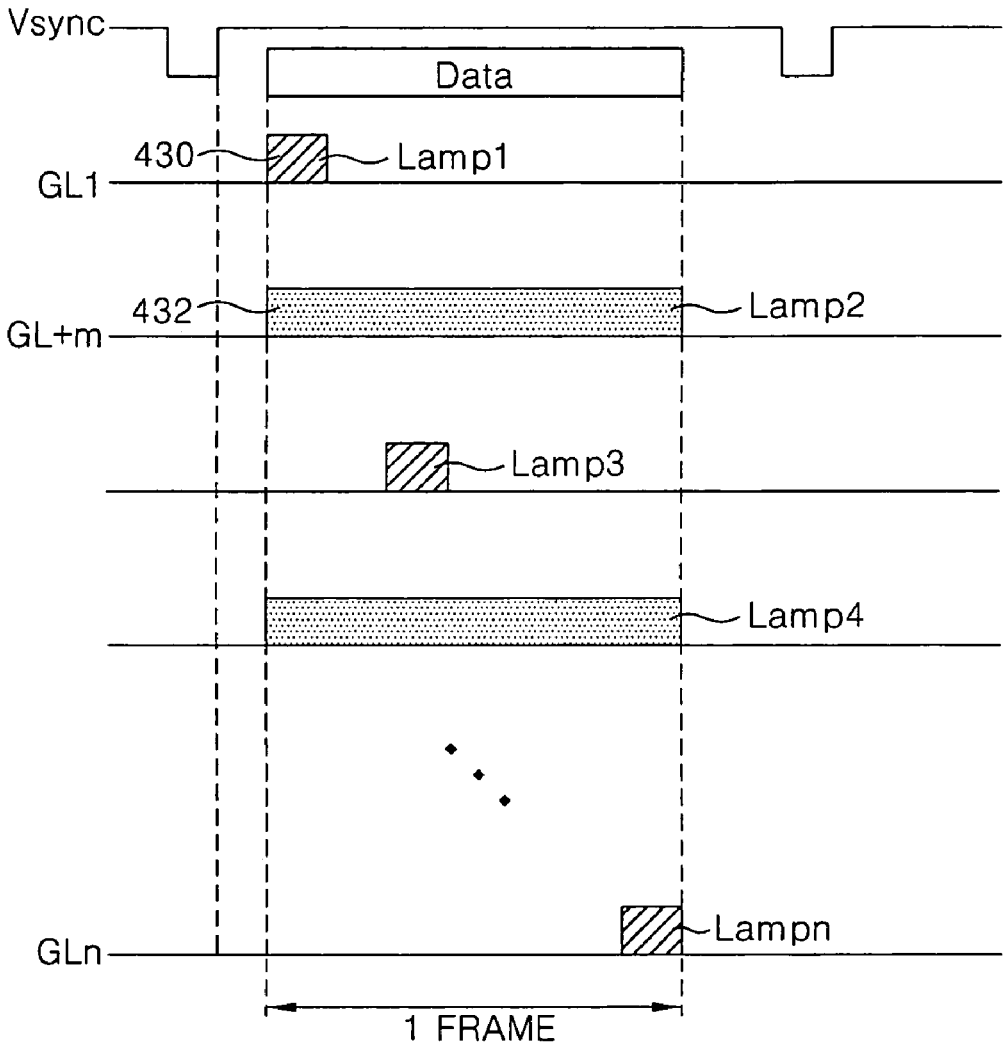
FIG. 12 is a timing diagram illustrating a driving method of the liquid crystal display according to the embodiment of the present invention of FIG. 11.

Referring to FIGS. 11 and 12, a driving apparatus of a liquid crystal display may include a plurality of lamps 430, 432 arranged in the first row in a lamp housing 422. A diffusion plate 420 is stacked on the lamp housing 422, and a liquid crystal display panel 402 is stacked above the diffusion plate 420. The driving apparatus of FIG. 11 has odd-numbered lamps 430 of the plurality of lamps 430, 432 driven by the scanning back light driving method to be turned on/off as shown in FIG. 12 and has even-numbered lamps 432 driven by the hold-type back light driving method to be turned on constantly. Further, the brightness is higher than that of the related art scanning back light driving method as shown in equation 4.

$$\text{Brightness} = (1/n + 1 + 1/n + 1 + \cdots + 1/n + 1)/1\ \text{Frame} \quad \text{[Equation 4]}$$

$$= (n/2 + 1/2)/1\ \text{Frame}$$

Alternatively, in the driving apparatus of the liquid crystal display according to the configuration as shown in FIG. 11, the odd-numbered lamps 430 of the plurality of lamps 430, 432 arranged in the lamp housing 422 may constantly maintain a turned-on state, and even-numbered lamps 432 may be driven by scanning back light driving method to be turned on/off. On the contrary, the driving apparatus makes odd-numbered lamps 430 among the plurality of lamps 430, 432 driven by the scanning back light driving method to be turned on/off and drives so that the even-numbered lamps 432 may maintain a constant turned-on state. As described above, the brightness is higher than that of the related art scanning back light driving method. The even-numbered lamps 432 driven by the scanning back light driving method can be driven sequentially upon scanning driving or the some of the lamps can be driven sequentially. As described above, the brightness achieved by the driving apparatus is higher than that of the related scanning back light driving method.

As described above, the driving apparatus and the method of the liquid crystal display according to the present invention arranges a plurality of lamps in at least two groupings in the lamp housing, wherein the some of these lamps are driven by the scanning driving method to sequentially turn on/off and the rest are driven by the hold-type driving method to constantly maintain a turned-on state. Here, the groupings may correspond to respective rows. Alternatively, the lamps may be arranged in one row, wherein odd-numbered (or even-numbered) lamps are driven by the scanning driving method to be turned on/off sequentially, and even-numbered (or odd-numbered) lamps are driven by the hold-type driving method to maintain a constant turned-on state. Hereby, the present invention can improve the brightness and reduce motion blurring.

It will be apparent to those skilled in the art that various modifications and variations can be made in the driving apparatus and method of liquid crystal display of the present invention without departing from the spirit or scope of the invention. Thus, it is intended that the present invention cover the modifications and variations of this invention provided they come within the scope of the appended claims and their equivalents.

What is claimed is:

1. A driving apparatus for a liquid crystal display, comprising:

a lamp housing;

a plurality of lamps arranged in the lamp housing; and a lamp driver to drive a first set of the plurality of lamps to sequentially turn on and off and to substantially simultaneously drive a second set of the lamps to be constantly turned on.

2. The driving apparatus of the liquid crystal display according to claim 1, wherein the lamp driver includes a first driver to sequentially turn on and off the first set of lamps, and a second driver to drive the second set of lamps to be constantly turned on.

3. The driving apparatus of the liquid crystal display according to claim 1, wherein the first set of lamps are arranged in a first row and the second set of lamps are arranged in a second row.

4. The driving apparatus of the liquid crystal display according to claim 3, wherein a current supplied to the first set of lamps is larger than a current supplied to the second set of lamps.

5. The driving apparatus of the liquid crystal display according to claim 3, wherein the each one of the first set of lamps are aligned with a corresponding one of the second set of lamps, the first and second sets of lamps having an equal number of lamps.

6. The driving apparatus of the liquid crystal display according to claim 3, wherein each one of the second set of lamps are aligned with an odd-numbered one of the first set of lamps.

7. The driving apparatus of the liquid crystal display according to claim 3, wherein each one of the second set of lamps are aligned with an even-numbered one of the first set of lamps.

8. The driving apparatus of the liquid crystal display according to claim 3, wherein the first and second sets lamps are arranged to define a zigzag pattern.

9. The driving apparatus of the liquid crystal display according to claim 3, wherein the first set of lamps are disposed closer to a liquid crystal display panel of the liquid crystal display than the second set of lamps.

10. The driving apparatus of the liquid crystal display according to claim 3, wherein the second set of lamps are disposed closer to a liquid crystal display panel of the liquid crystal display than the first set of lamps.

11. The driving apparatus of the liquid crystal display according to claim 1, wherein the first and second sets of lamps are arranged in a row such that odd ones of the row of the lamps define the first set of lamps, and even ones of the row of the lamps define the second set of lamps.

12. The driving apparatus of the liquid crystal display according to claim 11, wherein the row of the lamps are arranged substantially parallel to a liquid crystal display panel of the liquid crystal display.

13. The driving apparatus of the liquid crystal display according to claim 1, wherein the first and second sets of lamps are arranged in a row such that even ones of the row of the lamps define the first set of lamps, and odd ones of the row of the lamps define the second set of lamps.

14. The driving apparatus of the liquid crystal display according to claim 13, wherein the row of the lamps are arranged substantially parallel to a liquid crystal display panel of the liquid crystal display.

15. A driving method for a liquid crystal display having a plurality of lamps disposed in a lamp housing, comprising the steps of:

sequentially turning on and off a first set of the plurality of lamps during one frame; and turning on a second set of the plurality of lamps simultaneously with the step of sequentially turning on and off the first set of lamps, the second set of lamps being turned on constantly during the one frame.

16. The driving method of the liquid crystal display according to claim 15, wherein a current supplied to the first set of lamps is larger than a current supplied to the second set of lamps.

17. The driving method of the liquid crystal display according to claim 16, wherein the first and second sets of lamps are arranged in a row substantially parallel to a liquid crystal display panel of the liquid crystal display.

18. The driving method of the liquid crystal display according to claim 17, wherein odd ones of the row of the lamps define the first set of lamps, and even ones of the row of the lamps define the second set of lamps.

19. The driving method of the liquid crystal display according to claim 17, wherein even ones of the row of the lamps define the first set of lamps, and odd ones of the row of the lamps define the second set of lamps.

20. A liquid crystal display, comprising:

a liquid crystal display panel;

a lamp housing having a plurality of lamps arranged therein to provide light to the liquid crystal panel; and a lamp driver to drive a first set of the plurality of lamps to sequentially turn on and off and to substantially simultaneously drive a second set of the lamps to be constantly turned on.

* * * * *